US009014408B2

(12) United States Patent
Thomé et al.

(10) Patent No.: US 9,014,408 B2
(45) Date of Patent: Apr. 21, 2015

(54) SUBWOOFER STRUCTURE AND ADJUSTING METHOD

(75) Inventors: Jan Thomé, Turku (FI); Mika Isotalo, Turku (FI)

(73) Assignee: Aura Audio Oy, Lieto (FI)

( * ) Notice: Subject to any disclaimer, the term of this patent is extended or adjusted under 35 U.S.C. 154(b) by 491 days.

(21) Appl. No.: 13/322,816

(22) PCT Filed: May 31, 2010

(86) PCT No.: PCT/FI2010/000039

§ 371 (c)(1), (2), (4) Date: Mar. 21, 2012

(87) PCT Pub. No.: WO2010/136639

PCT Pub. Date: Dec. 2, 2010

(65) Prior Publication Data

US 2012/0189150 A1 Jul. 26, 2012

(30) Foreign Application Priority Data

May 29, 2009 (FI) ..... 20090218

(51) Int. Cl.

| | |
|---|---|
| ***H04R 1/02*** | (2006.01) |
| ***H04R 9/06*** | (2006.01) |
| ***H04R 1/30*** | (2006.01) |
| ***H04R 1/28*** | (2006.01) |

(52) U.S. Cl.

CPC ..... *H04R 1/30* (2013.01); *H04R 1/2842* (2013.01); *H04R 1/2849* (2013.01); *H04R 1/2865* (2013.01)

(58) Field of Classification Search

CPC ..... H04R 1/28; H04R 1/34; H04R 1/02; H04R 5/02

USPC ..... 381/335, 336

See application file for complete search history.

(56) References Cited

U.S. PATENT DOCUMENTS

| | | | | |
|---|---|---|---|---|
| 2,805,729 | A | 9/1957 | Read | |
| 2,858,899 | A | 11/1958 | Lopez-Henriquez | |
| 3,047,090 | A | 7/1962 | Pruden | |
| 4,230,905 | A | 10/1980 | Grum | |
| 4,860,367 | A | 8/1989 | Hook | |
| 5,189,706 | A | 2/1993 | Saeki | |
| 6,801,633 | B2 * | 10/2004 | Tracy | 381/389 |
| 7,513,332 | B2 | 4/2009 | Moore | |

(Continued)

FOREIGN PATENT DOCUMENTS

| | | | |
|---|---|---|---|
| AU | 2003246307 | A1 | 4/2004 |
| DK | 9200119 | U | 2/1993 |
| DK | 9900337 | U | 1/2000 |
| EP | 1592281 | A2 | 11/2005 |
| EP | 1655992 | A1 | 5/2006 |

*Primary Examiner* — Alexander Jamal

(74) *Attorney, Agent, or Firm* — Kubovcik & Kubovcik

(57) ABSTRACT

A subwoofer (10) structure comprised of a transducer (30) located in a loudspeaker enclosure (11), an acoustic duct (21) expanding in a horn-like manner, a frontal chamber (40) and an aperture (22). A sound wave emanating from the transducer is conveyed via the acoustic duct portion expanding in a horn-like manner to the frontal chamber, and a sound wave emanating from the opposite side of the transducer is conveyed either to a closed space (20) or directly to the frontal chamber. The subwoofer can be adjusted without altering the external dimensions of the loudspeaker enclosure, utilising the entire volume of the loudspeaker enclosure, so that the frontal chamber is tuned by altering the size of the frontal chamber and/or the size of the aperture in the frontal chamber.

8 Claims, 7 Drawing Sheets

(56) References Cited

U.S. PATENT DOCUMENTS

| | | | |
|---|---|---|---|
| 2004/0173402 | A1 | 9/2004 | Morkerken |
| 2007/0080019 | A1 | 4/2007 | Kubota |
| 2008/0110692 | A1 | 5/2008 | Moore |
| 2008/0130932 | A1 | 6/2008 | Schultz |
| 2009/0087008 | A1 | 4/2009 | Danley |

* cited by examiner

SUBWOOFER STRUCTURE AND ADJUSTING METHOD

OBJECT OF THE INVENTION

The object of the invention is a subwoofer structure comprised of a loudspeaker enclosure having at least one transducer, at least one acoustic duct, and at least one aperture to transmit the sound wave generated by the transducer out of the loudspeaker enclosure.

PRIOR ART

Sound reproduction requires large subwoofers to produce low-frequency sound, and the transducers used in them require large amplifier power. It would thus be advantageous to achieve good results with a smaller loudspeaker enclosure and lower amplifier power. However, subwoofers currently in use require large enclosures to function properly. Due to this, various attempts have been made to improve loudspeaker efficiency and sensitivity.

Patent publication U.S. Pat. No. 3,912,866 discloses a known subwoofer structure wherein the transducer is located in an opening in the closed space and directed towards the rear wall of the enclosure. A pyramid-like structure located in conjunction with the enclosure disperses the sound wave, both vertically and horizontally, into acoustic ducts located on opposite sides of the transducer and shaped like an expanding horn, and directs the sound wave towards the open front wall of the enclosure. Such a structure is very complex. To improve the characteristics of the subwoofer, it is necessary to round the acoustic ducts, which makes manufacturing of the enclosure difficult.

Patent publication U.S. Pat. No. 7,513,332 has a known subwoofer structure wherein the transducer is located in an opening of a closed space, wherein the opening is made narrow, in contrast to the shape of the transducer. The sound wave generated by the transducer is distributed to the sides, in two portions, by means of the inclined surfaces of the enclosure and further on into expanding, horn-shaped ducts. Disturbingly abrupt changes in the direction of the sound waves are prevented by means of the inclined surfaces, but the structure becomes very complex and large. Sound exiting from the loudspeaker enclosure has been conveyed via two separate openings located at the sides of the enclosure, and due to this the subwoofer structure is only optimally suited for the corner of the listening environment.

Patent publication U.S. Pat. No. 5,189,702 shows a subwoofer structure where the sound wave generated by the transducer is conveyed via a resonator chamber. The efficiency and sound pressure level (SPL) generated by such a loudspeaker are poor.

PURPOSE OF THE INVENTION

The purpose of this invention is to create a new subwoofer structure that eliminates the above-mentioned disadvantages and provides better efficiency and sensitivity than known solutions.

Characteristics of the Subwoofer According to the Invention

The subwoofer structure according to the invention is characterised in that the subwoofer structure includes at least one acoustic duct comprising an acoustic duct portion that expands in the direction of sound propagation, and a frontal chamber.

Embodiments of the Subwoofer According to the Invention

According to one advantageous embodiment of the invention, the structure is comprised of at least one expanding acoustic duct portion starting from the transducer, as an extension of the expanding acoustic duct portion, a frontal chamber, and an aperture through which the sound wave exits the loudspeaker.

According to another advantageous embodiment of the invention, in the subwoofer structure, the first sound wave emanating from the first or the second side of the transducer is conveyed to a closed space, and the second sound wave emanating from the opposite side of the transducer is conveyed to the expanding acoustic duct portion, into the frontal chamber arranged in an extension thereof, and further on to the aperture.

According to a third advantageous embodiment of the invention, in the subwoofer structure, the first sound wave emanating from the first or the second side of the transducer is conveyed to a closed space, the second sound wave emanating from the opposite side of the transducer is divided and conveyed to two or more expanding acoustic duct portions, and at least one expanding acoustic duct portion has a frontal chamber as its extension, from where the sound wave exits via an aperture.

According to a fourth advantageous embodiment of the invention, in the subwoofer structure, the first sound wave emanating from the first or the second side of the transducer is conveyed to a closed space, the second sound wave emanating from the opposite side of the transducer is divided and conveyed to two or more expanding acoustic duct portions, each expanding acoustic duct portion has a separate frontal chamber as its extension, and each frontal chamber includes an integrated aperture, through which the sound wave exits the loudspeaker.

According to a fifth advantageous embodiment of the invention, in the subwoofer structure, the first sound wave emanating from the first or the second side of the transducer is conveyed to a closed space, the second sound wave emanating from the opposite side of the transducer is divided and conveyed to two or more expanding acoustic duct portions, at least two expanding acoustic duct portions include a frontal chamber as an extension of the acoustic duct portion, and sound waves are conveyed from said frontal chambers to a single joint frontal chamber, from where the sound wave exits via one or more apertures.

According to a sixth advantageous embodiment of the invention, in the subwoofer structure, the first sound wave emanating from the first or the second side of the transducer is conveyed to an expanding acoustic duct portion and to its extension, the first frontal chamber, from where the sound wave exits via the aperture of this frontal chamber, and the second sound wave emanating from the opposite side of the transducer is conveyed to the second frontal chamber, from where the sound wave exits via the aperture of this frontal chamber.

According to a seventh advantageous embodiment of the invention, in the subwoofer structure, the first sound wave emanating from the first or the second side of the transducer is conveyed to an expanding acoustic duct portion and to its extension, the first frontal chamber, the second sound wave emanating from the opposite side of the transducer is conveyed to the second frontal chamber, and from said first and second frontal chambers, the first and the second sound wave are conveyed to a joint frontal chamber, from where the merged sound wave exits via one or more apertures.

According to an eighth advantageous embodiment of the invention, in the subwoofer structure, the first sound wave emanating from the first or the second side of the transducer is conveyed to an expanding acoustic duct portion and further on to its extension, a frontal chamber, the second sound wave emanating from the opposite side of the transducer is conveyed to the same frontal chamber as said first sound wave, and in the frontal chamber, said sound waves are merged and exit via one or more apertures.

According to a ninth advantageous embodiment of the invention, in the subwoofer structure, the cross-sectional area of the expanding acoustic duct portion changes in steps, and the last change in the cross-sectional area in the acoustic duct portion expanding in the direction of sound propagation forms the frontal chamber in conjunction with the aperture.

According to a tenth advantageous embodiment of the invention, in the subwoofer structure, the stepwise change in the cross-sectional area of the expanding acoustic duct portion in the direction of sound propagation essentially corresponds to a known expanding horn structure, or at least some of the changes in the cross-sectional area expand and/or contract as required, and/or remain the same.

Other advantageous embodiments of the subwoofer structure according to the invention include the following:

1. In the subwoofer structure, the cross-sectional area of the expanding acoustic duct portion changes in steps, and the direction of the acoustic duct simultaneously makes a 90° or a 180° turn at the location of change.
2: In the subwoofer structure, the frontal chamber is in the front portion of the subwoofer, in conjunction with the aperture, and the aperture, comprised of a single or more openings, opens up in the front wall of the subwoofer.
3. In the subwoofer structure, the expanding acoustic duct portion is divided into two or more portions which merge in the frontal chamber in conjunction with the aperture.
4. In the subwoofer structure, the expanding acoustic duct portions divided into two or more portions are mutually similar, or they differ from one another in their cross-sectional areas, length or in their expansion or contraction characteristics as required.
5. The subwoofer structure includes a loudspeaker enclosure with an aperture in its front wall, a closed space inside the loudspeaker enclosure, a transducer located in the opening of the closed space so that the sound wave generated by the transducer is substantially directed towards the rear wall of the loudspeaker enclosure, acoustic ducts located between the closed space and the speaker enclosure, on opposite sides of the closed space, via which the sound wave propagates into joint or separate frontal chambers and further out of the loudspeaker, via one or more apertures in the front wall of the loudspeaker enclosure.

6. In the subwoofer structure, the loudspeaker enclosure is essentially rectangular, the closed space is also essentially rectangular, one or more openings are formed in the rear wall of the closed space, for one or more transducers, and the closed space is located essentially inside the loudspeaker enclosure so that acoustic ducts are situated between the loudspeaker enclosure and the closed space, the acoustic ducts going around the closed space essentially in its entirety, on its opposite sides, and merge in the frontal chamber and open up in one or more apertures in the mid portion of the front wall of the loudspeaker enclosure.

7. The subwoofer is rectangular in structure so that the walls of the loudspeaker enclosure, the walls of the expanding acoustic duct portion and the walls of the frontal chamber form rectangular structures.
8. In the subwoofer, the dimensions of the aperture in the front portion are designed such that the transducer can be installed and/or replaced from the front of the subwoofer, via the aperture, and the closed space inside has a maintenance hatch that opens up towards the front portion of the subwoofer and, via this hatch, the transducer for said space can be installed and/or replaced via the front portion of the subwoofer.

9. In the subwoofer structure, the expanding acoustic duct portion can be adjusted so as to set the cross-sectional area of any of the stepwise changing portions to the required value, or in the acoustic duct, the location or the size of any of the panels forming its wall is changed.
10. In the subwoofer structure, the frontal chamber can be adjusted so that the size of the aperture in conjunction with the frontal chamber is changed by relocating one or more edges of the aperture, or by altering the number of apertures.

A Method for Adjusting Subwoofers

The object of the invention is furthermore a method for adjusting a subwoofer comprised of a loudspeaker enclosure having at least one transducer, at least one acoustic duct, and at least one aperture to transmit the sound wave generated by the transducer out of the loudspeaker enclosure.

Characteristics of the Method

The method according to the invention is characterised in that the subwoofer is adjusted so that the acoustic duct portion starting from the transducer is adjusted to the required shape so that the change in the cross-sectional area of the acoustic duct portion, such as expansion or contraction, corresponds to the required horn shape or other shape at each location of the acoustic duct portion, and/or the size, location or shape of the frontal chamber, being an extension of said acoustic duct portion, is altered, and/or the size and/or location of one or more apertures in conjunction with the frontal chamber is altered.

Embodiments of the Method

An advantageous embodiment of the method according to the invention is characterised in that the subwoofer is adjusted so that the expanding acoustic duct portion of the subwoofer is divided into two or more portions which merge in the frontal chamber in conjunction with the aperture, and the expanding acoustic duct portions divided into two or more portions are arranged in a similar way, or so that they differ from one another in their cross-sectional areas, lengths or in their expansion or contraction characteristics as required.

Another advantageous embodiment of the method according to the invention is characterised in that the subwoofer is adjusted so that the first sound wave emanating from the first or the second side of the transducer is conveyed, via the expanding acoustic duct portion, to a frontal chamber in conjunction with the aperture, the second sound wave emanating from the opposite side of the transducer is conveyed to said frontal chamber, and in the frontal chamber, said sound waves are merged and allowed to exit via one or more apertures.

A third advantageous embodiment of the method according to the invention is characterised in that the subwoofer is adjusted so that the cross-sectional area of the expanding acoustic duct portion is altered so as to transform the expanding acoustic duct portion adjacent to the aperture into a frontal chamber.

A fourth advantageous embodiment of the method according to the invention is characterised in that the subwoofer is adjusted so that the cross-sectional area of the expanding acoustic duct portion is altered stepwise as required so that, in the acoustic duct portion, the location or the size of any of the panels forming its wall is altered, and a 90° or 180° turn is simultaneously made in the direction of the acoustic duct.

In a subwoofer according to the invention, the transducer is joined with a horn structure, which additionally comprises a tunable frontal chamber. The frontal chamber of the subwoofer functions as a resonator which can easily be tuned by altering its size and/or the size of its aperture. In this combination the horn structure can be of the conventional type or it can be shaped nonlinear as required. In the latter case the frontal chamber may consist of an expansion formed in the horn close to its aperture or of a straight portion or a narrowed portion formed in the aperture. As the frontal chamber is tuned by altering its size and/or the size of its aperture the subwoofer according to the invention can be adjusted without altering its external dimensions, and thus the entire volume of the loudspeaker enclosure can be utilised. If necessary, also the shape of the horn structure can be adjusted so that it differs from a conventional linear or exponential horn shape.

A subwoofer according to the invention can also be built using a simple rectangular loudspeaker enclosure, the entire volume of which can be utilised. Thus the subwoofer can be made surprisingly small in size. According to the invention, the loudspeaker enclosure can also be built so that the horn-like acoustic duct is arranged by a simple rectangular structure. This way, the corners of the acoustic duct do not have to be rounded or chamfered in any way.

By using a frontal chamber in conjunction with the horn structure, the subwoofer can be tuned to the required frequency range. This simultaneously results in a lower intensity of higher frequencies of sound and a higher intensity of low-frequency sounds. As a result, an increase of up to 2 or 3 dB in SPL can be achieved in the required frequency range using the same amplifier power and without increasing the external dimensions of the subwoofer. A further advantage of the structure according to the invention is that the required frequency range and efficiency increase can be achieved even if the horn structure is made utilising entirely rectangular structures, changing stepwise. No chamfers or roundings whatsoever are needed in the corners and stepwise alterations of the cross-sectional area.

Either one opening or several smaller openings can be used for tuning the aperture of the resonator chamber. Generally, decreasing the size of the aperture narrows down the frequency range while simultaneously increasing SPL within this range. According to one advantageous embodiment of the invention, the largest SPL increase can be achieved in the frequency range of 50 to 200 Hz.

In a subwoofer according to the invention, the transducer can be in a closed space, and the sound wave conveyed through an opening in the closed space, via one or more horn structures, to the frontal chamber and, from there, out of the loudspeaker via an aperture. If there is more than one horn structure, they can be of similar size and symmetrical, but the horn structures can also differ from one another in size or width.

In an alternative structure, the transducer is attached to the opening of the closed space so that the magnet of the transducer is outside the closed space, providing more efficient cooling for the transducer. Even in this embodiment, a sound wave generated by the transducer propagates via the horn structure and the frontal chamber to the aperture.

According to one embodiment of the invention, the subwoofer has an open structure such that the sound waves from both sides of the transducer are conveyed to the same joint frontal chamber and from there out of the loudspeaker via the aperture. In this case the transducer is located close to the joint frontal chamber or in conjunction with a separate frontal chamber of its own from where the sound wave from one side of the transducer can propagate directly to the joint frontal chamber. The sound wave from the first side of the transducer, on the other hand, is conveyed, via a horn structure of the required shape, to a frontal chamber of its own or into a joint tunable frontal chamber where the out-of-phase sound waves are merged and exit from the subwoofer via the aperture.

It is advantageous to make the aperture of the subwoofer sufficiently large in order to install the transducer and maintain it via the aperture. If the transducer is inside the closed space, the closed space should additionally have a maintenance hatch through which the transducer can be installed and maintained. Most advantageously, the maintenance hatch opens up on the aperture side of the subwoofer, whereby no other hatches in the subwoofer enclosing are necessary. In some cases the maintenance hatch can also be made in the back wall of the subwoofer.

Most advantageously, the structure of the subwoofer is rectangular so that all the external as well as internal wall structures of the loudspeaker enclosure are at a straight angle to each other. Such a structure is strong and easy to manufacture. A subwoofer according to the invention is characterised in that angled acoustic ducts, and 90° or 180° angles in the ducts do not impair its functionality in any way.

In all various structures according to the invention, the subwoofer can have a single transducer or several transducers located either in the same space or in separate spaces. The subwoofers can also be combined by arranging any number of them close to each other so as to operate simultaneously.

According to the invention, charging a transducer or transducers symmetrically from both sides of the cone is utilised in the subwoofer structure. This solution diminishes the offset of the cone by 50% compared with known solutions and eliminates variations in impedance and motion deviation between transducers operating in varying acoustic environments, generating thus an identical load to all cone transducers operating in parallel circuit within the same system.

A solution according to the invention enables extreme enclosure stiffness without additional supports, utilising the entire volume of the enclosure and creating a minimum flow at the enclosure corners. The minimum flow provides a linearly functioning duct at the corners of the acoustic duct, which are difficult to realise. The overall volume of air mass also correspondingly increases as no rounded corners are needed.

According to the invention:

A symmetrical double horn doubles the usable upper limit frequency.

The enclosure structure is made rigid by means of all the incorporated parts, without any additional support.

Symmetric charging, without 180° corners, eliminates non-linearity at the interface of minimum and maximum flow.

Advantageous use of space, without any unnecessary components.

Maximum SPL from a smaller enclosure.

Lower distortion and linear functioning across the entire frequency range in use.

According to the invention, there is an opening for the transducer, equal in size to the entire transducer, in the back wall of the closed space. The closed space is entirely inside the enclosure so that, at least on its opposite sides, it is distanced from the enclosure walls. This creates an acoustic duct in these spaces so that a pressure wave emanating from the transducer is divided into these acoustic ducts, i.e. an acoustic duct pair. In the acoustic ducts, pressure waves circumvent the closed space and are conveyed out of the enclosure front wall, either via one opening or via adjacent openings, located close to each other. In the latter case, the adjacent openings are most advantageously located in the middle of the enclosure front wall. The acoustic ducts located on opposite sides of the closed space can be located horizontally, at the sides of the closed space, or vertically, above and below it.

According to one advantageous embodiment, the acoustic ducts circumventing the closed space expand in the direction of propagating sound waves at least in a portion of the acoustic duct. According to another embodiment, the total surface area of the opening or adjacent openings in the front wall of the subwoofer is essentially half of the surface area of the front wall of the enclosure. According to a third advantageous embodiment, adjacent straight portions of the acoustic duct circumventing the closed space are essentially at a 90° angle to each other. Thus the propagating sound wave does not have to make bends larger than 90°, which makes rounding of the acoustic duct corners unnecessary. According to the invention, an acoustic duct with 90° angles provides a subwoofer according to the invention with a remarkably good and even frequency curve.

According to the invention, the closed space of the subwoofer structure may also comprise several transducers, which can be grouped in various ways, side by side and/or on top of each other. On the other hand, the acoustic ducts left between the closed space and the enclosure in the subwoofer structure can also by divided in various ways by horizontal and/or vertical partition walls. Thus there may be one or more transducers in conjunction with a single acoustic duct. A sound wave produced by a single transducer can also be divided so that it propagates via several horizontal and/or vertical acoustic ducts.

Examples of Embodiments

In the following, the invention is described using examples with reference to the appended drawings, in which

LIST OF FIGURES

FIGS. 1 and 2 are schematic views of known loudspeaker solutions according to the prior art.

FIGS. 3 to 10 are schematic views of loudspeaker structures according to the invention.

FIGS. 11 to 13 show various embodiments of the invention.

FIGS. 14 to 17 show frequency curves according to the invention.

FIGS. 18 to 38 show various embodiments of the invention.

Figure 1:
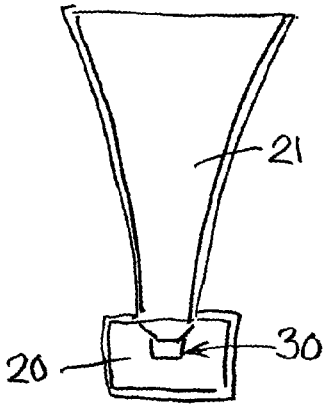
FIG. 1 is schematic view of a known loudspeaker structure according to the prior art where an acoustic duct 21 is generally a horn which expands either linearly or exponentially. It is essential for known horn structures that an expanding and as unobstructed a passage 21 as possible is provided for the sound wave emanating from the transducer 30 to the free space outside the loudspeaker.
Figure 2:
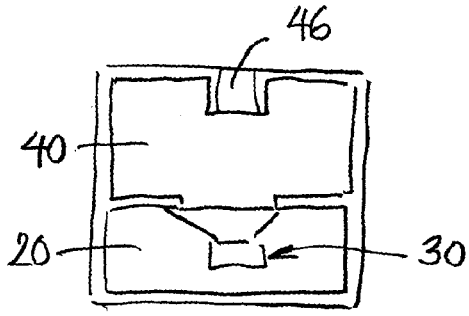
FIG. 2 shows a schematic view of a known structure according to the prior art with a resonator chamber 40 in conjunction with the transducer 30. The resonator chamber 40 is used in subwoofers, but its efficiency is poor with a wide reproduction range.
Figure 3:
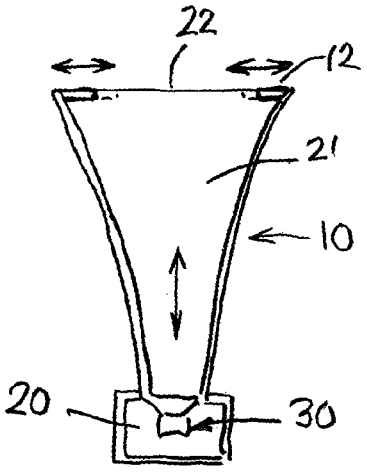
FIG. 3 shows a schematic view of a new loudspeaker structure 10 according to the invention, with a horn-like, expanding acoustic duct 21 and, in conjunction with the duct, a frontal chamber 40. The frontal chamber 40 is provided by choking the expanding acoustic duct 21 at a required location, whereby the structure becomes non-linear. What is novel and inventive about the solution is that a structure made non-linear in a controlled way alters the reproduction range of the subwoofer 10 but at the same time also significantly increases the SPL and efficiency of the subwoofer 10. In addition to choking, the subwoofer 10 can be adjusted by altering the length of the acoustic duct 21.
Figure 4:
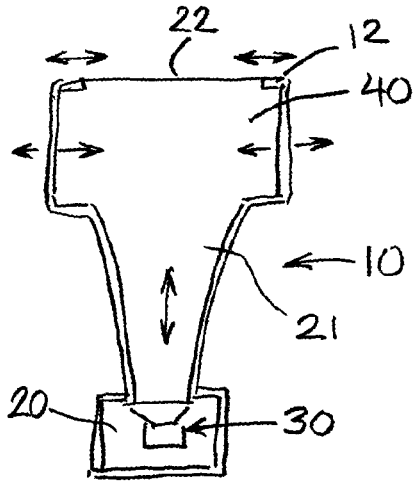
FIG. 4 shows a schematic view of another embodiment of the subwoofer 10 shown in FIG. 3 with a frontal chamber 40 arranged in an extension of the expanding acoustic duct 21 so that, seen in the direction of sound wave propagation, the cross section of the acoustic duct 21 is first dramatically increased and then decreased. The subwoofer 10 can be adjusted by adjusting the volume of the frontal chamber, the size of the aperture or the length of the acoustic duct.
Figure 5:
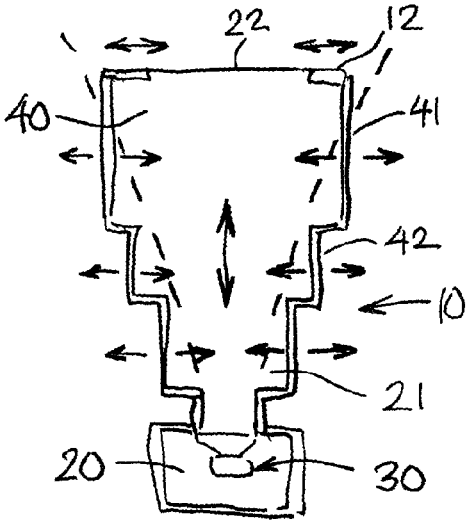
FIG. 5 shows an embodiment of the subwoofer 10 where the expanding acoustic duct 21 is formed from several different portions with various cross-sectional areas. The last portion located close to the aperture 22 in the acoustic duct 21 is formed as a frontal chamber 40 by decreasing the aperture 22. This provides a choke at the aperture 22 compared with the shape of the expanding acoustic duct 21. This subwoofer 10 can be adjusted, similar to the embodiment shown in FIG. 4, by altering the length of the acoustic duct 21 and the front wall 12, whereby the size of the aperture 22 changes. Furthermore, the walls 41 affecting the size of the frontal chamber 40 and the walls 42 affecting the shape of the acoustic duct 21 can be altered.
Figure 6:
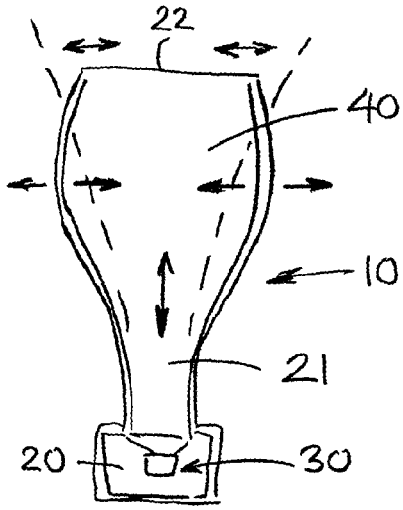
FIG. 6 shows an embodiment of the subwoofer 10 where the frontal chamber 40 is provided by first dramatically expanding the acoustic duct 21 and then contracting it.
Figure 7:
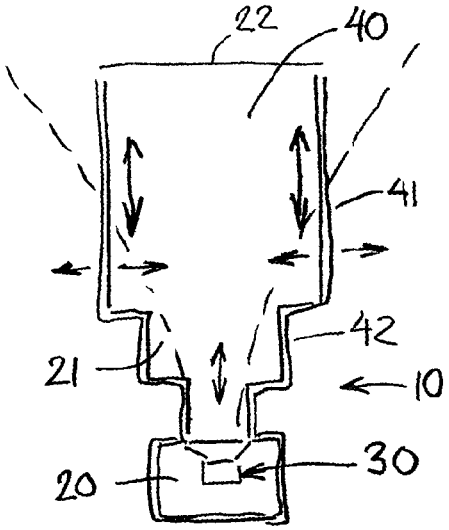
FIG. 7 shows an embodiment of the subwoofer 10 where, viewed in the direction of sound propagation, the length of the last portion of the expanding acoustic duct 21 is altered. By extending the last portion, the sides of which are marked by the reference number 41, the expanding acoustic duct 21 can be contracted, whereby it becomes non-linear, and the portion 40 functions similarly to a frontal chamber.
Figure 8:
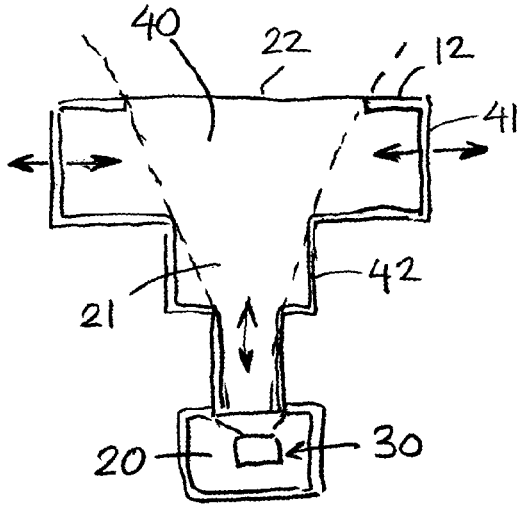
FIG. 8 shows an embodiment of the subwoofer 10 where the expanding acoustic duct 21 is furthermore formed from several different portions 41 and 42 with various cross-sectional areas. A frontal chamber 40 is provided in conjunction with the aperture 22 of the acoustic duct 21, and the aperture 22 has a choke. The frontal chamber 40 here is formed so wide, however, that despite the choke in the aperture 22 the entire acoustic duct area combined with the frontal chamber 40 essentially corresponds to the shape of an expanding horn.
Figure 9:
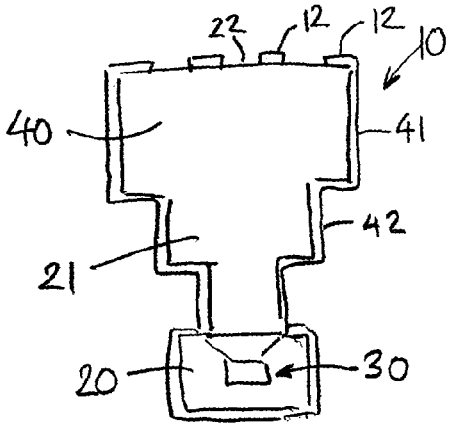

In the embodiment shown in FIG. 9, the aperture 22 in conjunction with the frontal chamber 40 of the subwoofer 10 has been reduced in size so that, instead of one large opening, the aperture 22 consists of several smaller openings.

Figure 10:
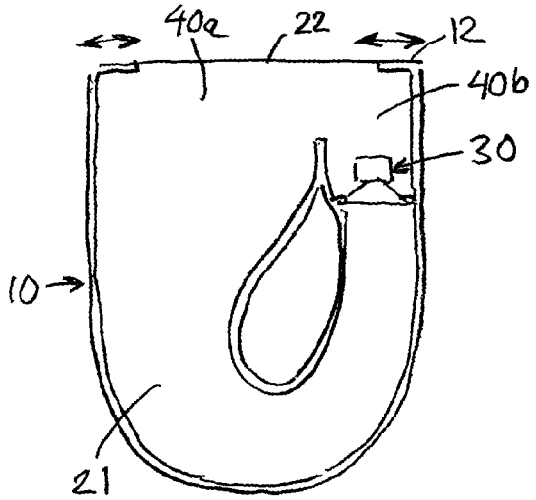

FIG. 10 shows a principle diagram of a subwoofer 10 according to the invention where the transducer 30 is in conjunction with a horn-like acoustic duct 21 so that the sound wave propagates via the acoustic duct 21 into a tunable frontal chamber 40*a*. On the opposite side of the transducer 30, the sound wave propagates into a second tunable frontal chamber 40*b*. Both sound waves merge and exit the loudspeaker through the aperture 22. The functioning of the subwoofer 10 is adjusted by altering the aperture 22 of the frontal chamber 40, which in this type of solution increases the sensitivity of the horn loudspeaker by 2 to 3 dB.

Figure 11:
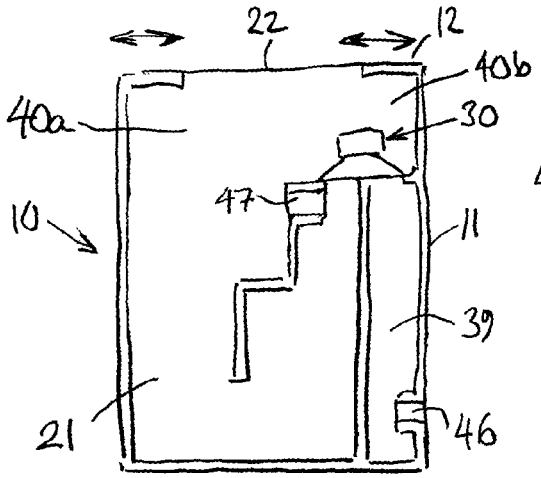

FIG. 11 shows a subwoofer 10 according to the invention where, in its loudspeaker enclosure 11, the transducer 30 is also in conjunction with a horn-like acoustic duct 21 so that the sound wave propagates via the acoustic duct 21 to a tunable frontal chamber 40*a*. Also on the opposite side of the transducer 30, the sound wave propagates into the second tunable frontal chamber 40*b*. However, this embodiment additionally has a resonator chamber 39 equipped with a reflex port 46. If required, a reflex port 47 can also be added between the start of the acoustic duct 21 and the frontal chamber 40*a*. The frontal chambers 40*a* and 40*b*, the size of the aperture 22, and the resonator chamber 39 provide highly variable means of tuning the subwoofer 10 to function as required.

Figure 12:
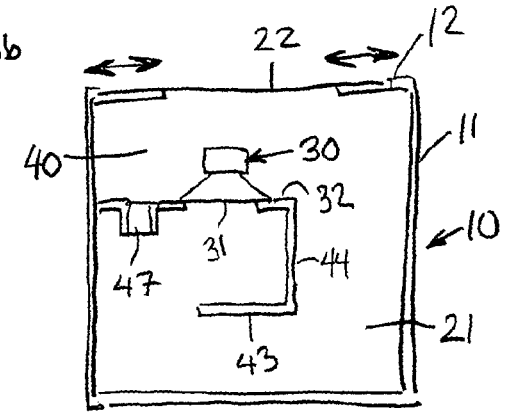

FIG. 12 shows a subwoofer 10 with the transducer 30 attached to a transducer fixture plate 32 and located in an open space in conjunction with the frontal chamber 40. The first sound wave from the cone 29 side of the transducer 30 is directed into a horn-like acoustic duct 21 of the loudspeaker enclosure 11. The first sound wave merges with the second sound wave from the magnet 28 side of the transducer 30 in the frontal chamber 40, from where the sound wave exits via the aperture 22. Furthermore there is a reflex port 47 between the start of the acoustic duct 21 and the frontal chamber 40*a*. The frontal chamber 40 can be tuned by altering the size of the aperture 22 located in the mid portion of the front wall 12 of the loudspeaker enclosure 11.

Figure 13:
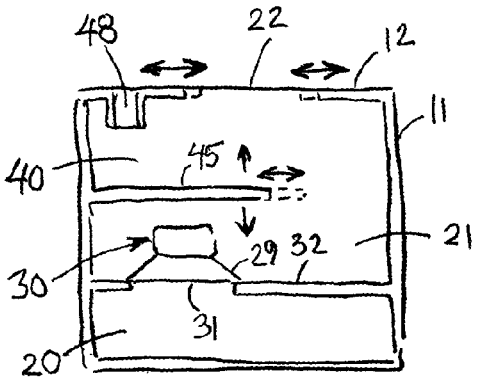

FIG. 13 shows a subwoofer 10 where the transducer 30 is attached to a fixture plate 32, which forms a wall of the closed space 20. In this embodiment the cone 29 side of the transducer 30 is directed towards the closed space 20 and the magnet 28 side is in the open space, whereby the transducer 30 diminishes the start portion of the horn and also cools more efficiently. The sound wave generated by the cone 29 side of the transducer 30 is conveyed via the acoustic duct 21 to the frontal chamber 40 and via the aperture 22 out of the loudspeaker enclosure 11. The shape and functioning of the acoustic duct 21 can be adjusted by altering the size and/or location of the wall 45. The frontal chamber 40 is tuned by designing the dimensions of the reflex port 48 as required and by adjusting the size and location of the aperture 22 in the front wall 12 of the loudspeaker enclosure 11. Altering the size and/or location of the wall 45 also alters the size and functioning of the frontal chamber 40.

Figure 14:
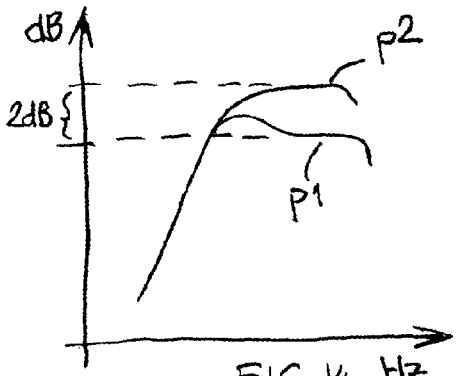

FIG. 14 shows an example of frequency curves where curve p1 represents the frequency curve of a subwoofer without a frontal chamber and curve p2 represents the frequency curve of a subwoofer with a frontal chamber. As FIG. 11 shows, the efficiency of the subwoofer increases substantially as the increase in SPL achieved by means of the frontal chamber is as much as 2 to 3 dB. It should be noted that this increase is achieved using the same amplifier power and without any changes in the external dimensions of the subwoofer.

Figure 15:
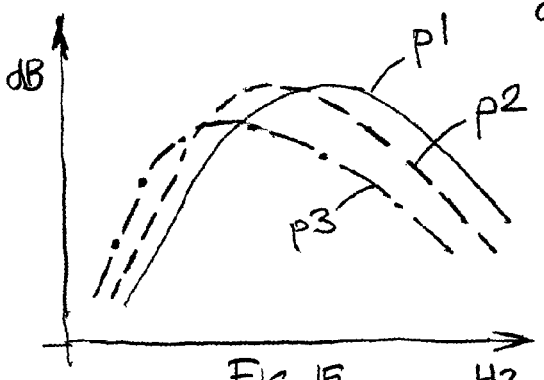

FIG. 15 shows an example of the frequency curves of a subwoofer equipped with a frontal chamber. Curve p1 represents the initial situation, before the adjustments. As curves p2 and p3 show, the frequency curve undergoes a change when the aperture in the frontal chamber is made smaller or the frontal chamber is made smaller.

Figure 16:
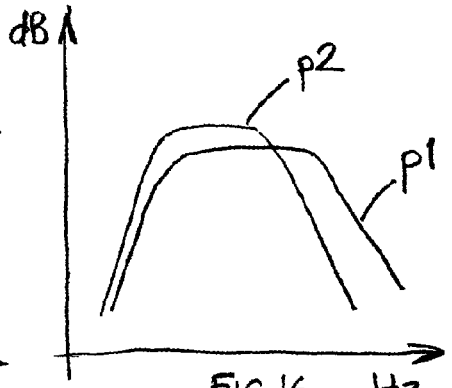

The frequency curve shown in FIG. 16 demonstrates one effect achieved by the subwoofer adjustment method according to the invention. Curve p1 represents an initial situation. As the aperture of the subwoofer or its frontal chamber is made smaller, the frequency range of the subwoofer shifts lower, as indicated by curve p1, which simultaneously provides an increase of 2 to 3 dB in sensitivity with the same enclosure size and the same amplifier power.

Figure 17:
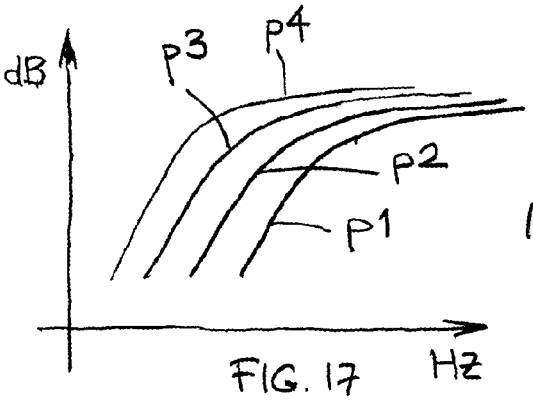

FIG. 17 shows the frequency curves p1, p2, p3 and p4 of a subwoofer according to the invention. Curve p1 represents the frequency curve of a single subwoofer 10, and curve p2 represents the frequency curve obtained when two subwoofers operate simultaneously, parallel to one another. Curve p3 represents three subwoofers and curve p4 correspondingly four joint subwoofers. The subwoofers in this example may be similar to the subwoofers in FIG. 28, for instance.

Figure 18:
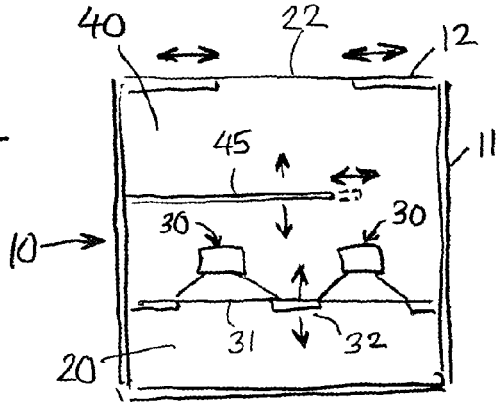

FIG. 18 shows a subwoofer 10 that essentially corresponds with the subwoofer shown in FIG. 13. In this embodiment, two transducers 30 have been attached to a fixture plate 32 which forms a wall of the closed space 20. Here, as well as in the rest of the examples shown in the figures, it is essential that the loudspeaker structure can always have two or more transducers 30 in parallel instead of a single transducer 30. Tuning possibilities in accordance with the invention, such as altering the size of the frontal chamber, altering the size of the aperture, and altering the shape and length of the acoustic duct function in a similar way with several transducers as well as with a single transducer. Adjustment operations possible in FIG. 18 include for instance altering the location of the fixture plate 32, altering the location and size of the plate 45 in the acoustic duct 21 and altering the size of the aperture 22.

Figure 19:
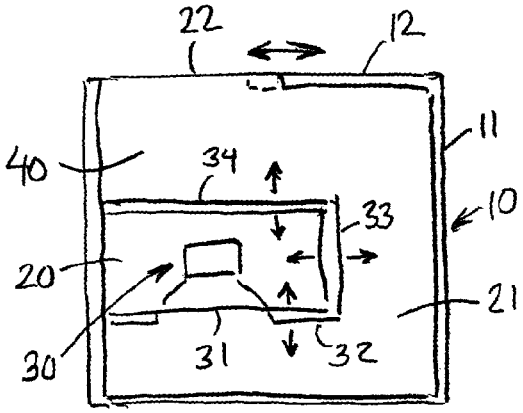

FIG. 19 shows a cross-sectional view of a subwoofer 10 according to the invention with a closed space 20 inside the loudspeaker enclosure 11, and inside the closed space a transducer 30. The fixture plate 32 of the transducer 30 is a wall of the closed space 20, in the opening 31 of which the transducer 30 has been attached. According to the invention, the loudspeaker enclosure 11 of the subwoofer 10 can be tuned by altering the location and/or size of the plates 32, 33 and 33 inside the enclosure. If a wall 33 of the closed space 20 is relocated inside the loudspeaker enclosure 11, the acoustic duct 21 becomes narrower at this location. If, on the other hand, another wall 34 of the closed space 20 is relocated, this changes the shape and size of the frontal chamber 40 in conjunction with the aperture 22. The size of the frontal plate 12 can furthermore be altered, which alters the size of the aperture 22 as well.

Figure 20:
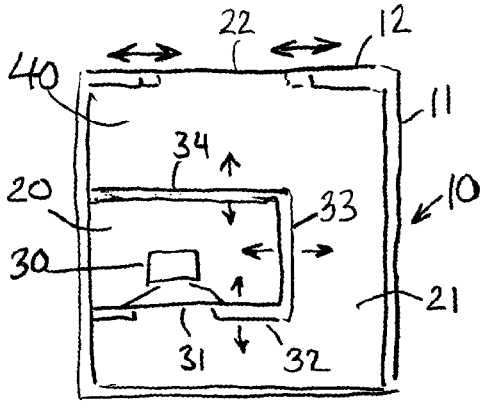

FIG. 20 shows a subwoofer 10 otherwise corresponding to the one shown in FIG. 19 but in this embodiment the front wall 12 of the loudspeaker enclosure 11 can be altered on both sides of the aperture 22 to reduce the size of the aperture 22.

Figure 21:
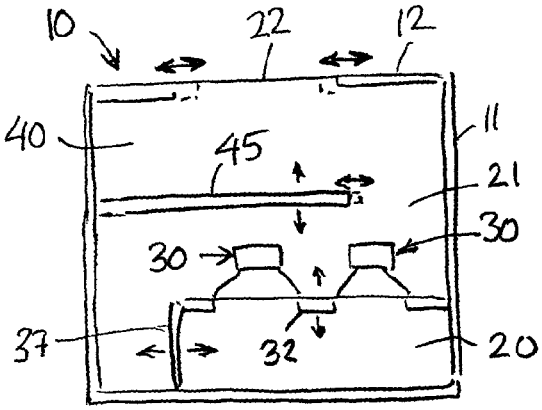

FIG. 21 shows a subwoofer 10 in other respects corresponding the one shown in FIG. 18 but in this embodiment the closed space 20 is smaller. In FIG. 21 the acoustic duct 21 continues to the left half of the closed space 20, which makes the acoustic duct 21 longer and affects the reproduction range of the subwoofer 10.

Figure 22:
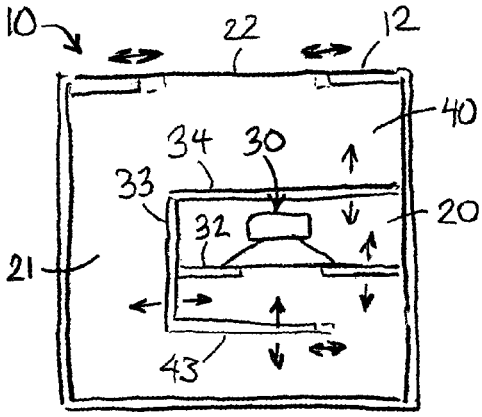

FIG. 22 shows an embodiment of the subwoofer 10 where an acoustic duct starting from the closed space 20 is arranged longer by means of a partition plate 45. According to the invention, tuning of the subwoofer 10 is carried out similarly as with the previous embodiments.

Figure 23:
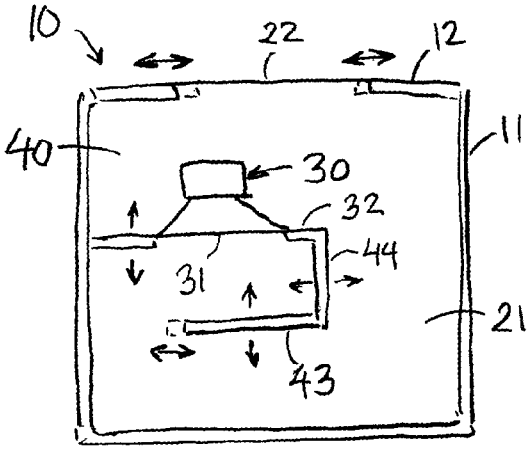

FIG. 23 shows a subwoofer 10 with the transducer 30 attached to a transducer fixture plate 32 and located in an open space in conjunction with the frontal chamber 40. The first sound wave from the cone 29 side of the transducer 30 is directed into the horn-like acoustic duct 21 of the loudspeaker enclosure 11. Said first sound wave merges with the second sound wave from the magnet 28 side of the transducer 30 in the frontal chamber 40, from where the sound wave exits via the aperture 22. Functioning of the frontal chamber 40 can be adjusted by altering the size of the aperture 22 located in the mid portion of the front wall 12 of the loudspeaker enclosure 11. Functioning of the subwoofer 10 can also be adjusted by altering the location and/or size of the walls 43 and 44 of the acoustic duct 21.

Figure 24:
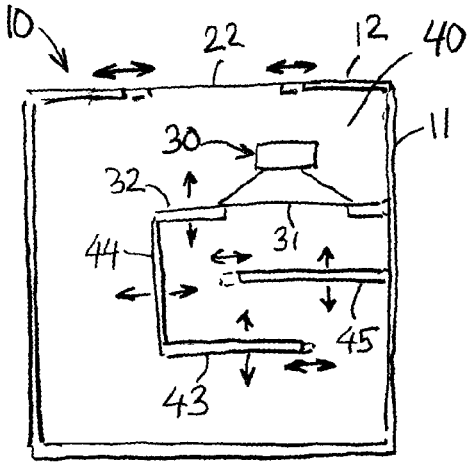

The subwoofer 10 shown in FIG. 24 corresponds the embodiment in FIG. 23 in other respects but the acoustic duct 21 is arranged longer by means of a partition plate 45.

Figure 25:
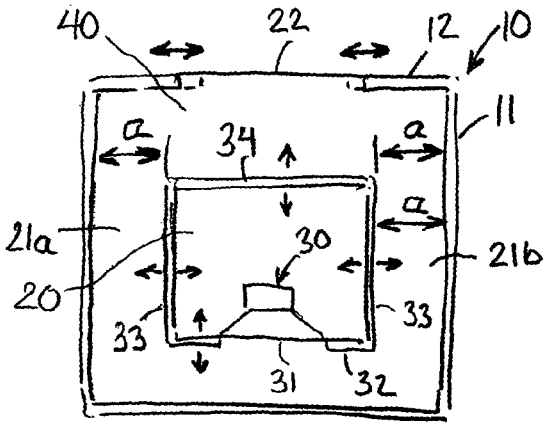

FIG. 25 shows a subwoofer 10 with the transducer 30 in a closed space 20, and the sound wave generated by the transducer 30 is divided into two portions and conveyed via two acoustic duct portions 21*a* and 21*b* equal in size to a frontal chamber 40 where the sound wave portions merge and exit the speaker enclosure 11 via an aperture 22. FIG. 18 shows that the widths (a) of the acoustic ducts 21*a* and 21*b* are equal.

Figure 26:
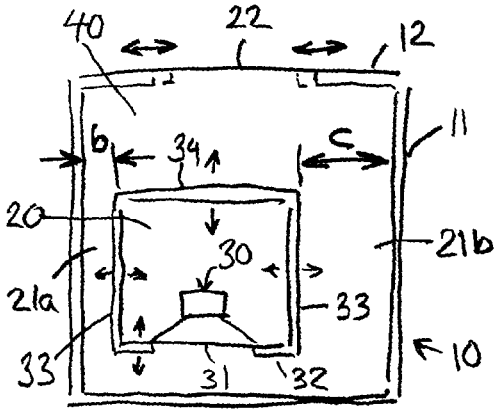

Also in the subwoofer 10 shown in FIG. 26, the sound wave generated by the transducer 30 is divided into two portions and conveyed via two acoustic duct portions 21*a* and 21*b* to a joint frontal chamber 40. In this embodiment, the sizes of the acoustic ducts 21*a* and 21*b* are not equal. FIG. 19 shows the unequal widths (b) and (c) of the acoustic ducts 21*a* and 21*b*.

Figure 27:
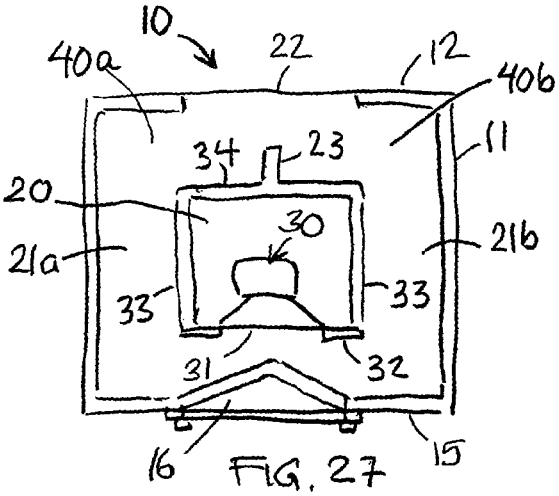

FIG. 27 shows the loudspeaker enclosure of a subwoofer 10 where the frontal chambers 40*a* and 40*b* of acoustic ducts 21*a* and 21*b* in part merge, as they only have a small partition wall 23 between them. Thus the front wall 12 of the loudspeaker enclosure 11 has only one aperture 22.

Figure 28:
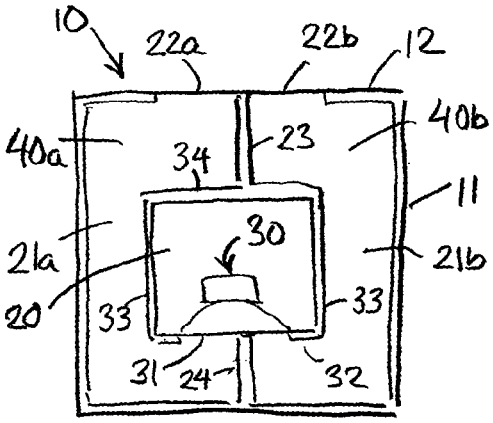

FIG. 28 shows a subwoofer 10 with a single transducer 30 in the loudspeaker enclosure 11. The sound wave generated by the transducer is divided into two portions by a partition wall 24 separating the acoustic ducts 21*a* and 21*b* from each other in front of the transducer 30. Also the frontal chambers 40*a* and 40*b* and the apertures 22*a* and 22*b* are separate from one another.

Figure 29:
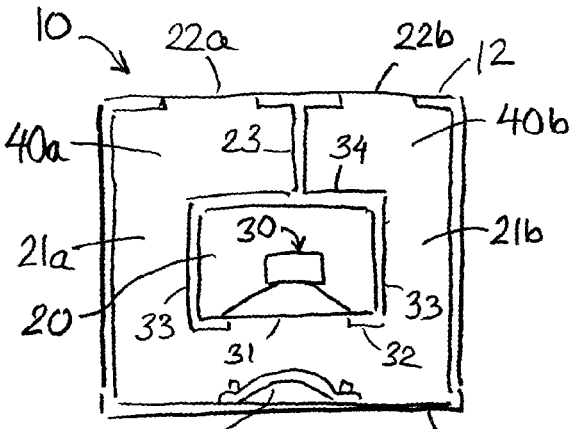

FIG. 29 shows a subwoofer 10 with a portion of its front wall 12 located in the middle of the loudspeaker enclosure 11, whereby the frontal chambers 40*a* and 40*b* are clearly set apart, and similarly the front wall also has two apertures 22*a* and 22*b* that are set apart from each other.

Figure 30:
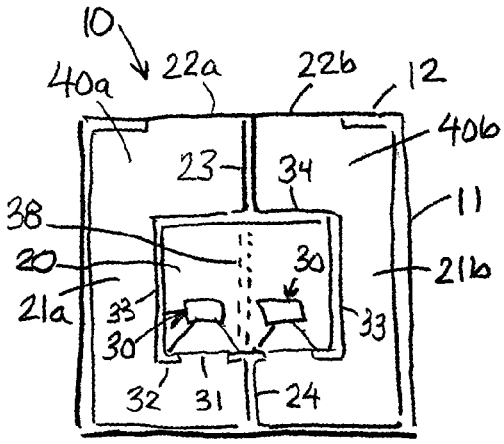

FIG. 30 shows a subwoofer 10 with two transducers 30, two acoustic ducts 21*a* and 21*b*, two frontal chambers 40*a* and 40*b* and two apertures 22*a* and 22*b*. Partition walls 23 and 24 divide the acoustic ducts and the frontal chambers into two portions. According to one embodiment, a partition wall 38 can be added also in the closed space 20, whereby two separate halves are formed in the subwoofer 10. Such a solution is advantageous particularly if one wants to combine several subwoofers into a single system with a lower frequency range than that of a single subwoofer, as shown in FIG. 17.

Figure 31:
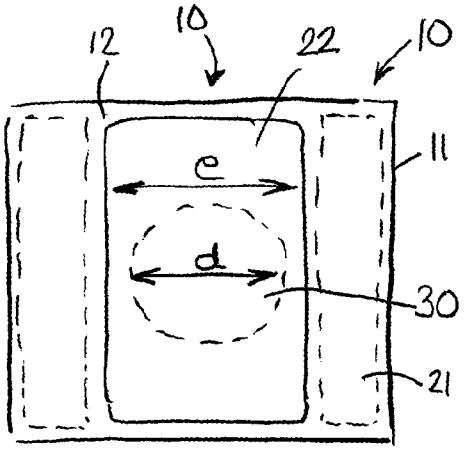

FIG. 31 shows a front view of the structure of the subwoofer 10 in FIG. 30, including the aperture 22 in its front wall. According to one advantageous embodiment, the surface area of the aperture 22 is approximately half of the surface area of the front wall 12. It is also advantageous in terms of installation and maintenance if the aperture 22 is wider than the diameter of the transducer 30. This way the transducer 30 can be installed via the aperture 22.

Figure 32:
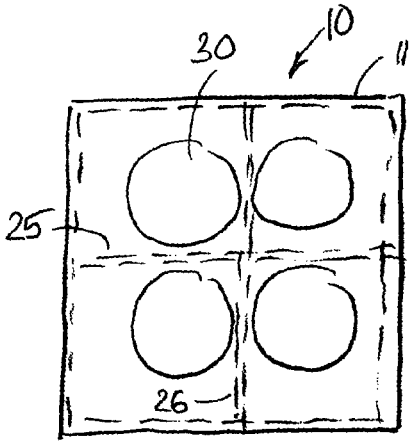

FIG. 32 shows a schematic view of the structure of the subwoofer 10, with four transducers 30 side by side.

Figure 33:
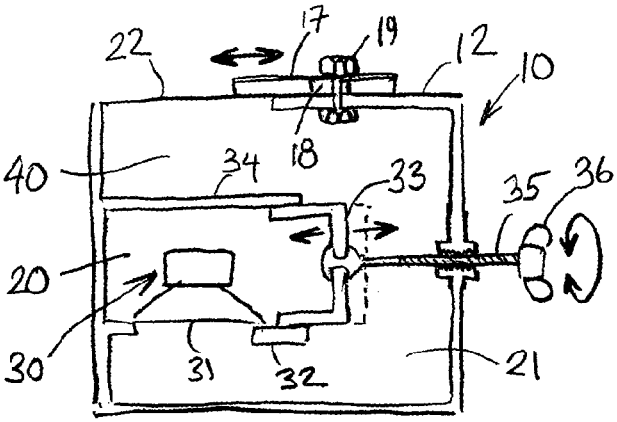

FIG. 33 shows an adjustment option of the subwoofer 10 according to the invention. A threaded bar 35 is joined with the loudspeaker enclosure 11, one end of the bar being joined with the movable wall 33 of the shut enclosure 20. When the turning means 36 of the threaded bar 35 is rotated, the wall 33 correspondingly moves. This alters the volume of the closed space 20, chokes the acoustic duct 21 and enlarges the frontal chamber 40. There is, furthermore, an adjustment plate 17, secured in place by a screw 19, in conjunction with the aperture 22. When the screw 19 is loosened, the adjustment plate 17 can be moved to a required location, after which the screw 19 is again tightened. This makes it possible to easily adjust the size of the aperture 22.

Figure 34:
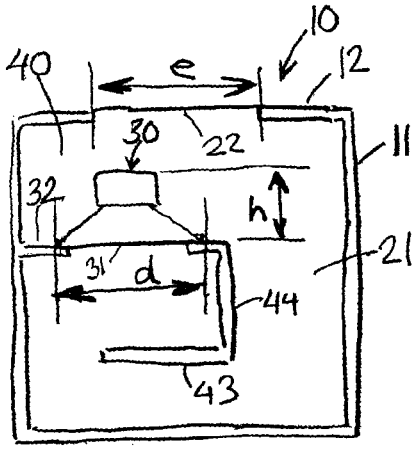

FIG. 34 shows an example of the dimensions of the loudspeaker enclosure 11 of a subwoofer 10. When the transducer 30 is located in the frontal chamber or in the open acoustic duct 21 and the diameter of the transducer 30 is (d), the width of the aperture 22 in the frontal plate of the loudspeaker enclosure 11 is set at (e), which is at least equal to or larger than the diameter (d) of the transducer 30. This way the transducer 30 can be installed and maintained via the aperture 22, and no other openings are required in the loudspeaker enclosure 11.

Figure 35:
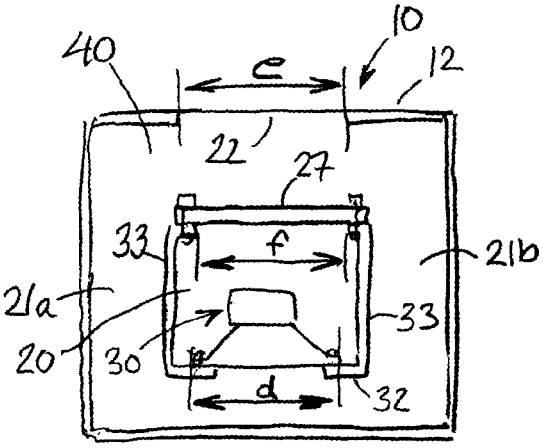

FIG. 35 shows an example of the dimensions of the loudspeaker enclosure 11 of a subwoofer 10 with the transducer 30 with a diameter (d) located in a closed space 20. To enable installation and maintenance of the transducer 30 via the aperture 22 even in this case, the width of the aperture 22 must also here be at least equal to the diameter (d) of the transducer 30. Because the transducer 30 is in the closed space 20 inside the loudspeaker enclosure 11, an opening and a hatch 27 have to be made even in this space. The width (f) of the opening in the closed space 20 must then also be at least equal to the diameter (d) of the transducer 30.

Figure 36:
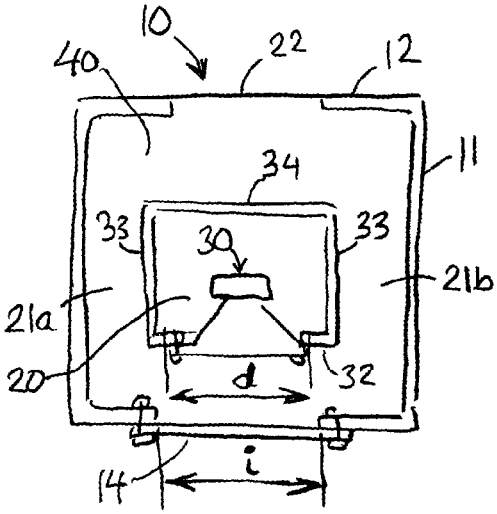

FIG. 36 shows an example of the dimensions of the loudspeaker enclosure 11 of a subwoofer 10 when the transducer 30 must be installed via the back wall of the enclosure 11. The width (i) of the hatch 14 opening must be larger than the diameter (d) of the transducer 30.

Figure 37:
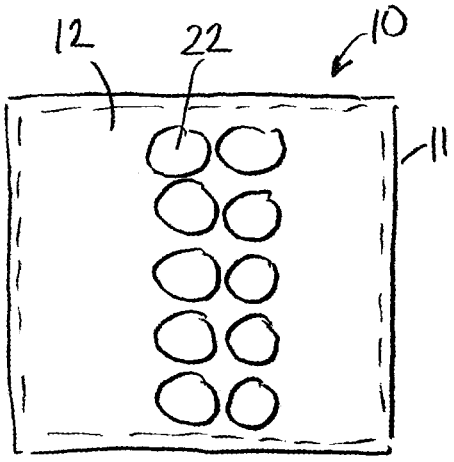

FIG. 37 shows further another example of the aperture 22 in the loudspeaker enclosure 11 of a subwoofer 10, the aperture being formed from several small openings instead of a single large one. This solution is advantageous for instance when closing and opening of the apertures 22 is made easy to tune the subwoofer 10. An obvious disadvantage is that the transducer 30 does not fit through the apertures 22, and due to this there must be another opening for the transducer 30.

Figure 38:
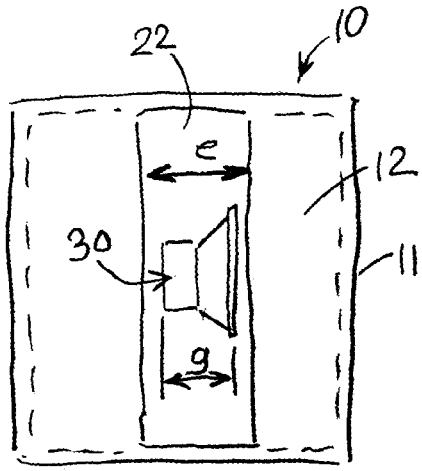

FIG. 38 shows yet another example of the dimensions of the loudspeaker enclosure 11 of a subwoofer 10. If the aperture 22 in the loudspeaker enclosure 11 of the subwoofer 10 is high or otherwise elongated, its width (e) does not necessarily have to be equal to the diameter (d) of the transducer 30. The transducer 30 generally has a shallow structure, making it sufficient to have an aperture 22 width at least equal to the height (g) of the transducer 30. In this case, the transducer 30 can be installed and maintained via the aperture 22.

Motion of the cone 29 of the transducer 30 generates a sound wave on both sides of it. Due to this, the transducer 30 can generally be installed in the opening 31 in the transducer fixture plate 32 that forms the wall, facing either direction. However, in this case the transducer 30 is defined so that the concave side of the cone 29 is the first side of the transducer 30, and the sound wave directed in this direction is the first sound wave. Correspondingly, the magnet 28 side is the second side of the transducer 30, and the sound wave directed in this direction is the second sound wave.

In compliance with the definition presented above, FIG. 15 shows the second side of the transducer 30 directed towards the closed space 20 and the first side of the transducer 30 directed towards the open acoustic duct 21. In some cases it is advantageous to place the second side of the transducer 30, i.e. the magnet 28 side, in an open space because this will provide more efficient cooling of the transducer 30.

According to one advantageous embodiment, the width (e) of the aperture 22 in the loudspeaker enclosure 11 of the subwoofer 10 is approximately double the height (h) of the frontal chamber 40.

In all presented embodiments of the subwoofer where only one transducer 30 is indicated in the loudspeaker enclosure, there could, according to the invention, just as well be several transducers 30 instead of one transducer, placed in various groups side by side as well as on top of one another. Transducers 30 can be located in the same space or distributed in separate spaces by various partitioning or stiffening walls.

Additional Notes

It is obvious to a person skilled in the art that the different embodiments of the invention may vary within the scope of the claims presented below. Add a reflex enclosure or a reflex port as a third variable.

List Of Reference Numbers

10 Subwoofer
11 Loudspeaker enclosure
12 Front wall
14 Hatch
15 Back wall
16 Wiring enclosure
17 Adjustment plate
18 Groove
19 Screw
20 Closed space
21 Acoustic duct
22 Aperture
23 Partition wall
24 Partition wall
25 Partition wall
26 Partition wall
27 Hatch
28 Magnet of the transducer
29 Cone of the transducer
30 Transducer
31 Opening of the transducer
32 Fixture plate of the transducer
33 Wall of the closed space
34 Wall of the closed space
35 Threaded bar
36 Turning means
37 Wall of the closed space
38 Partition wall
39 Resonator chamber
40 Frontal chamber
41 Wall of the frontal chamber
42 Wall of the acoustic duct
43 Wall of the acoustic duct
44 Wall of the acoustic duct
45 Wall of the acoustic duct
46 Reflex port
47 Reflex port
48 Reflex port
a Width of the acoustic duct
b Width of the acoustic duct
c Width of the acoustic duct
d Diameter of the acoustic duct
e Width of the aperture
f Width of the opening in the closed space
g Height of the transducer
h Height of the frontal chamber
i Width of the hatch
p Frequency curve

The invention claimed is:

1. A subwoofer comprising a loudspeaker enclosure formed by front and back walls, side walls, and top and bottom walls; a transducer having a cone side and a magnet side and being attached to a transducer fixture plate provided in the loudspeaker enclosure; a horn-like, expanding acoustic duct starting from the transducer; and an aperture formed in a front wall of the loudspeaker enclosure through which a sound wave generated by the transducer and conveyed by the expanding acoustic duct to the aperture is conveyed out of the loudspeaker enclosure, the subwoofer having a rectangular structure such that walls of the loudspeaker enclosure and walls of the expanding acoustic duct form rectangular structures, and the cross-sectional area of the expanding acoustic duct changes in steps and the direction of the acoustic duct makes a 90° or a 180° turn at the location of a change, and wherein the subwoofer includes a frontal chamber for tuning the subwoofer to a required frequency range and/or increasing a sound pressure level of the subwoofer, the frontal chamber being arranged in a front portion of the subwoofer such that the frontal chamber is the last portion of the expanding acoustic duct close to the aperture, and the frontal chamber has walls of rectangular structure and is a decreased cross-section of the expanding acoustic duct formed by the aperture having a decreased cross-sectional area relative to that of the expanding acoustic duct adjacent the aperture such that the expanding acoustic duct is choked.

2. The subwoofer according to claim 1 wherein, in the subwoofer, the transducer is attached to the transducer fixture plate, the transducer fixture plate being located in an open space in conjunction with the frontal chamber such that a first sound wave from the cone side of the transducer is directed into the horn-like expanding acoustic duct of the loudspeaker enclosure, the said first sound wave merges with a second sound wave from the magnet side of the transducer in the frontal chamber, from where the sound wave exits via the aperture.

3. The subwoofer according to claim 1 wherein, in the subwoofer, the transducer is attached to a fixture plate which forms a wall of a closed space, and a first sound wave emanating from the first side of the transducer is conveyed to the closed space, and a second sound wave emanating from the opposite side of the transducer is conveyed to the expanding acoustic duct and to the frontal chamber, and further to the aperture.

4. The subwoofer according to claim 1 wherein, in the subwoofer, the transducer is attached to a fixture plate which forms a wall of the closed space, which is located inside the loudspeaker enclosure such that the expanding acoustic duct comprises a pair of acoustic ducts formed between the loudspeaker enclosure and the closed space, the pair of expanding acoustic ducts going around the closed space essentially in its entirety, on its opposite sides, and merging in the frontal chamber and opening up in the aperture in a mid portion of the front wall of the loudspeaker enclosure.

5. The subwoofer according to claim 1 wherein the dimensions of the aperture in the front portion of the subwoofer enclosure are such that the transducer can be installed and/or replaced and maintained, via the aperture.

6. The subwoofer according to claim 1 wherein, in the loudspeaker enclosure, the location or the size of a wall panel of the expanding acoustic duct portion or the frontal chamber can be changed for setting their cross-sectional areas.

7. The subwoofer according to claim 1 wherein, in the subwoofer, an edge of the aperture can be relocated for altering the size of the aperture of the frontal chamber in order to adjust the frequency range-of the subwoofer.

8. The subwoofer according to claim 1 wherein, in the subwoofer, the magnet aide of the transducer is arranged in the expanding acoustic duct or in the frontal chamber for providing an open space for more efficient cooling of the transducer.

* * * * *